US009561395B2

(12) United States Patent
Rogoff

(10) Patent No.: US 9,561,395 B2
(45) Date of Patent: Feb. 7, 2017

(54) ANKLE STRENGTHENING EXERCISE DEVICE

(71) Applicant: Scott Rogoff, Fullerton, CA (US)

(72) Inventor: Scott Rogoff, Fullerton, CA (US)

(73) Assignee: ST. JOSEPH HEALTH SYSTEM, Irvine, CA (US)

( * ) Notice: Subject to any disclaimer, the term of this patent is extended or adjusted under 35 U.S.C. 154(b) by 105 days.

(21) Appl. No.: 13/730,567

(22) Filed: Dec. 28, 2012

(65) Prior Publication Data

US 2014/0187388 A1 Jul. 3, 2014

(51) Int. Cl.

| | |
|---|---|
| ***A63B 21/00*** | (2006.01) |
| ***A63B 23/08*** | (2006.01) |
| ***A63B 21/04*** | (2006.01) |
| ***A63B 21/055*** | (2006.01) |
| *A63B 71/02* | (2006.01) |

(52) U.S. Cl.

CPC ..... *A63B 21/0442* (2013.01); *A63B 21/0552* (2013.01); *A63B 21/4015* (2015.10); *A63B 23/08* (2013.01); *A63B 21/00061* (2013.01); *A63B 21/00065* (2013.01); *A63B 2071/027* (2013.01)

(58) Field of Classification Search

CPC ..... A63B 21/0552; A63B 21/0442; A63B 23/03541; A63B 23/08; A63B 21/0557; A63B 21/143

USPC ..... 482/51, 69, 79–80, 92, 142, 143, 146, 482/148, 907–908; 602/32–33; 606/241; 601/5, 601/27–35

See application file for complete search history.

(56) References Cited

U.S. PATENT DOCUMENTS

| | | | | | |
|---|---|---|---|---|---|
| 1,399,606 | A | * | 12/1921 | Ferragamo | 602/23 |
| 2,760,774 | A | | 8/1956 | Perez | |
| 4,733,859 | A | * | 3/1988 | Kock et al. | 482/79 |
| 4,848,325 | A | * | 7/1989 | Lillie | 601/35 |
| 5,100,129 | A | * | 3/1992 | Porter et al. | 482/129 |
| 5,186,698 | A | * | 2/1993 | Mason et al. | 482/79 |
| 5,303,716 | A | * | 4/1994 | Mason et al. | 601/34 |
| 5,509,894 | A | * | 4/1996 | Mason et al. | 601/34 |
| 5,582,579 | A | * | 12/1996 | Chism et al. | 601/27 |
| 5,593,374 | A | * | 1/1997 | Gvoich | 482/123 |
| 5,645,516 | A | | 7/1997 | Foster | |
| 5,704,881 | A | * | 1/1998 | Dudley | 482/69 |
| 5,836,857 | A | | 11/1998 | Jennings | |

(Continued)

OTHER PUBLICATIONS

"Ankle Strengthening Exercises & Stretches—Ask Doctor Jo," published Aug. 6, 2012, YouTube video: https://youtu.be/g-iXYapbuqk, by AskDoctorJo.*

(Continued)

*Primary Examiner* — Andrew S Lo

(74) *Attorney, Agent, or Firm* — Stetina Brunda Garred & Brucker

(57) ABSTRACT

An ankle strengthening exercise device is disclosed. The device is intuitive and simple to use by a patient even without professional medical supervision since the device indicates a specific movement of a foot by pivoting an ankle of the patient. In particular, the device may have an extension member that can be positioned on a frame of the device. The foot of the patient may engage the device. An elastic member may be secured to the extension member and the foot. The direction of the elastic member indicates the direction the foot of the patient should move by pivoting his or her ankle to specifically work or strengthen and exercise a particular ankle muscle of the patient.

13 Claims, 6 Drawing Sheets

(56) References Cited

U.S. PATENT DOCUMENTS

| | | | | |
|---|---|---|---|---|
| 6,063,013 | A * | 5/2000 | Vathappallil | 482/121 |
| 6,283,897 | B1 * | 9/2001 | Patton | 482/79 |
| 6,390,957 | B1 * | 5/2002 | Knight | 482/79 |
| 6,592,502 | B1 * | 7/2003 | Phillips | 482/143 |
| 6,821,235 | B1 | 11/2004 | Johnson et al. | |
| 6,942,604 | B2 | 9/2005 | Teff | |
| 7,192,410 | B1 * | 3/2007 | Rodgers | 602/36 |
| 7,322,914 | B1 | 1/2008 | Vittone et al. | |
| 7,794,367 | B2 | 9/2010 | Hall et al. | |
| 8,083,654 | B1 * | 12/2011 | MacDonald et al. | 482/121 |
| 8,142,336 | B1 * | 3/2012 | Yates | 482/124 |
| 8,202,205 | B2 * | 6/2012 | Reade | 482/124 |
| 8,434,824 | B2 * | 5/2013 | Spinabella et al. | 297/423.1 |
| 8,622,880 | B1 * | 1/2014 | Collett | 482/130 |
| 2005/0043150 | A1 * | 2/2005 | Nitta et al. | 482/79 |
| 2006/0167397 | A1 * | 7/2006 | Walsh | 602/32 |
| 2006/0178607 | A1 * | 8/2006 | Evans | 602/33 |
| 2007/0191193 | A1 * | 8/2007 | Backes et al. | 482/79 |
| 2007/0232449 | A1 * | 10/2007 | Planke | 482/1 |
| 2007/0249971 | A1 * | 10/2007 | Doran | 601/27 |
| 2008/0255491 | A1 * | 10/2008 | Scott | 602/32 |
| 2009/0227929 | A1 * | 9/2009 | Gondringer | 602/33 |
| 2009/0270231 | A1 * | 10/2009 | Hall et al. | 482/79 |
| 2010/0261583 | A1 * | 10/2010 | Ferguson et al. | 482/79 |
| 2011/0071441 | A1 * | 3/2011 | Rodgers | 601/5 |
| 2013/0197403 | A1 * | 8/2013 | Sevy et al. | 601/5 |
| 2013/0211297 | A1 * | 8/2013 | Method | 601/34 |

OTHER PUBLICATIONS

Neurogym Technologies, Movement-Enabling Equipment, Ankle Trainer http://www.neurogymtech.com/products/ankle-trainer.

* cited by examiner

ANKLE STRENGTHENING EXERCISE DEVICE

CROSS-REFERENCE TO RELATED APPLICATIONS

Not Applicable

STATEMENT RE: FEDERALLY SPONSORED RESEARCH/DEVELOPMENT

Not Applicable

BACKGROUND

The device and method disclosed herein relate to a physical therapy device.

Ankle injuries are common and may be a result of weak muscles associated with the ankle. During typical daily activities, or in association with sport related activities, one or more muscles in the ankle can give way to stresses beyond their capacity due to associated weakness, which can lead to injury to the ankle joint, neural tissue and supportive structures. While recovering from, an ankle injury, the patient may he required to rest (i.e. not exercise) his or her ankle to allow for necessary healing to take place, however, this rest period can allow for further weakening or atrophy of ankle muscles. As a result, many ankle injuries require subsequent physical therapy to strengthen the muscles of the ankle to help allow the patient to recover to a necessary functional level and to help prevent, further injury from occurring again.

During physical therapy, the physical therapist evaluates the patient to assess the associated impairments of the joint and its supportive tissues (i.e. muscles). Based on the assessment, the physical therapist will develop a working diagnosis on what muscles appear to be weak or injured, which will then lead to appropriate treatment of those muscles—which often includes strengthening. However, since it can he time consuming or expensive for the patient to work with the therapist multiple times per week, patients are often educated on how to perform exercises on their own at home without supervision. By way of example and not limitation, the physical therapist may teach the patient to tie an elastic member around his or her foot and tie the other end of the elastic member to a leg of a chair or weight or other stationary object. The patient must readjust his or her body in order to move his or her foot by pivoting, his or her ankle in a particular manner in order to exercise and strengthen a particular muscle associated with the ankle. If the movement of the foot is slightly off, the muscle that needs to be strengthened is not strengthened. Rather, a different muscle altogether is exercised and strengthened. At home, the patient may not realize that be or she is performing the exercise incorrectly and strengthening the wrong muscle. Hence, defeating the purpose of the ankle exercise regimen.

Accordingly, there is a need in the art for an improvement for exercising an ankle of the patient.

BRIEF SUMMARY

The ankle strengthening exercise device disclosed herein addresses the needs discussed above, discussed below and those that are known in the art.

The ankle strengthening device may include a frame having a plurality of anchors distributed about the frame, an extension member that may be secured to any one of the plurality of anchors. An elastic member that may be secured to the extension member and a foot of the patient which rests on a cradle to properly position the foot with respect to the extension member. A direction, indicated by the elastic member represents the direction of movement of the patient's foot that should occur by pivoting the patient's ankle to exercise a particular muscle associated with the ankle. During movement of the ankle joint, the elastic member (attached to the foot) will provide resistance to specific ankle muscles based on the associated angular setup for which it has been designed and described by the therapist. Based on the specific directions and angular setup educated to the patient when using the device, he or she will have a much easier time strengthening each specific muscle(s) associated with their ankle. Any ankle movements that deviate from the simple and specific angles involved with the resistance band and extension member will make it apparent that the patient is incorrectly performing their ankle strengthening exercises. The elastic member should move primarily along its longitudinal axis during movement of the toot and rotation of the ankle. By way of example and not limitation, the elastic member should not move laterally more than 1 inch as the patient moves his or her foot in the direction indicated by the elastic member, in this manner, the patient is forced to work a particular muscle associated with his or her ankle. Any movement of the foot not in general alignment with, the direction of the elastic member would work a different muscle.

More particularly, an ankle strengthening exercise device for strengthening one or more muscles associated with an ankle is disclosed. The device may comprise a frame, a leg cradle, an extension member and an elastic member. The frame may have a plurality of anchors. The leg cradle is selectively positionable at various elevations on the frame and at various angles. The extension member may be secured to one of the plurality of anchors so that a distal end portion of the extension is positioned laterally or in front of the frame. The distal end portion of the extension member may have a hook or eyelet.

The elastic member may define first and second opposed end portions. The first end portion may be secured to a patient's foot. The second end portion of the elastic member may be removably secured to the hook or eyelet of the extension member.

A direction of the elastic member indicates a direction that a foot of the patient should make by pivoting an ankle of the patient to exercise and strengthen a particular muscle associated with the ankle.

The frame may comprise first and second upright members. Each of the upright members may have first and second sides. The first sides may have a slot for sliding the leg cradle up and down to vertically position the leg cradle. The second sides may have a plurality of anchors vertically positioned on the second sides for positioning the elastic member.

The slots of the first sides may be in alignment with each other so that the leg cradle may be positioned at various elevations on the frame and oriented at various angles.

The device may further comprise a plurality of extension members. Each extension member may have a different length and/or shape. The extension member may be straight or S shaped.

In another aspect, a method of instructing a patient to exercise and strengthen a muscle associated with an ankle of a patient without supervision is disclosed. The method may comprise the steps of setting a vertical and/or angular positions of a cradle on a frame of an ankle exercise device;

securing an extension, member to an anchor of the frame; securing an elongate elastic member to the extension member and a foot of the patient to provide resistance during an ankle exercise and indicate a direction of foot movement during the ankle exercise; and instructing the patient to move his/her foot by pivoting his/her ankle in the direction of the elongate elastic member.

The method may further comprise the step of recording a vertical position of the cradle, an angular orientation of the cradle, a particular anchor from a plurality of anchors to which the extension member is to be secured, In another aspect, a method of exercising arid strengthening a muscle associated with an ankle is disclosed. The method may comprise the steps of setting up vertical and/or angular positions of a cradle on a frame of an ankle exercise device; securing an extension member to an anchor of the frame; securing an elongate elastic member to the extension member and a foot of the patient, to provide resistance during an ankle exercise and indicate a direction of foot movement during the ankle exercise; and moving a foot by pivoting an ankle in the direction of the elongate elastic member.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
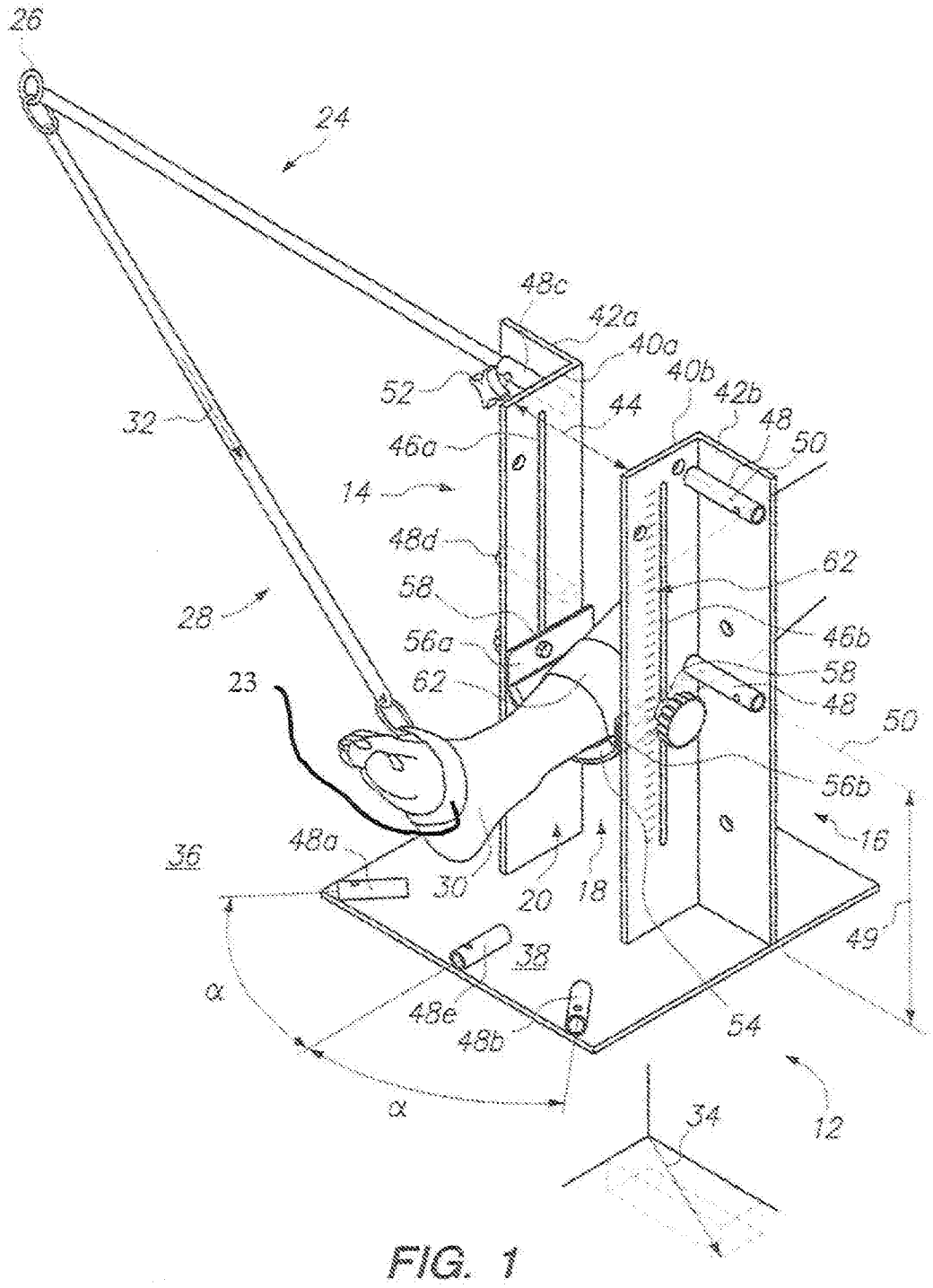
FIG. 1 is a perspective view of an ankle strengthening exercise device with, a foot of the patient set up for exercising a right tibialis posterior muscle.

Referring now to the drawings, an ankle strengthening exercise device 10 is shown. The device 10 includes a base 12 and first and second, upright members 14, 16. The upright, members 14, 16 may support an adjustable cradle 18 for supporting a leg 20 of the patient 22. An extension member 24 may be attached to the first or second upright members 14, 16 or the base 12. The distal end of the extension member 24 may have a hook (or eyelet) 26. An elastic band 28 may be secured to the hook (or eyelet) 26 of the extension member 24 and a cuff attached to a toot 30 of the patient 22 m order to exercise and strengthen a specific muscle of an ankle of the patient 22. The angular orientation of the band 28 indicates a direction 32 in which the patient's foot 30 by pivoting the ankle should move to exercise a specific muscle. The patient 22 pivots his or her foot 30 in alignment with the direction 32 of the band 28, The direction 32 of the band 28 is shown by arrow 32. The direction 34 of the patient's foot movement is shown by arrow 34. The device 10 is intuitive in that the patient 22 is instructed to move his or her foot 30 in line with the direction 32 of the band 28 by pivoting his or her ankle. By doing so, the device 10 targets a specific muscle for which the device 10 has been set up. Any other rotation of the ankle moving the foot 30 out of alignment with direction 32 of the band may exercise a different muscle and defeat, any physical therapy program of the patient 22. The patient 22 is exercising the wrong muscle, fortunately, the device 10 visually indicates the proper direction the foot 30 should be moved and the ankle rotated to exercise the correct muscle.

More particularly, the device 10 includes the base 12. The base 12 may be flat, and provide support for the first and second upright members 14, 60. The base 12 enables the device 10 to be supported on a fiat support surface 36 (e.g., ground, tabletop, bed, raised surface). The base 12 may define an upper surface 38 and a lower surface (not shown) which rests on the flat support surface 36.

The first, and second upright members 14, 16 may be secured to the upper surface 38 of the base 12. The first and second upright members may each have an angle configuration defining first and second plates 40*a, b*, 42*a, b*. The first plates 40*a, b* may be oriented parallel to each other. These first plates 40*a*, b may be gapped apart by distance 44. The distance 44 may be wider than the leg 20 of the patient so that the patient's leg 20 may be disposed therebetween. The first plates 40*a, b* may additionally have slots 46*a, b*. The slots 46*a, b* may be formed perpendicular to the upper surface 38 of the base 12 and be in alignment with each other.

The second plates 42*a, b* of the first and second upright members 14, 16 may be oriented perpendicular to the first plates 40*a, b*. The second plates 42*a, b* may additionally have a plurality of anchors 48. These anchors 48 may be placed at various heights 49 on the second plates 42*a, b*. Preferably, for each anchor 48 on the second plate 42*a* of the first upright member 14, a corresponding anchor 48 is mounted to the second plates 42*d* of the second upright member 16. The drawings illustrate two anchors 48 on each of the second plates 42*a, b* However, one or more anchors 48 may be mounted to the second plates 42*a, b* of the first and second upright members 14, 16. The anchors 48 may have a tubular construction with an open end oriented, laterally outward. The anchors 48 may each define a central axis 50 that is parallel to the upper surface 38 of the base 12. The anchors 48 may additionally have a threaded hole that receives a set screw with an adjustment, knob 52.

Anchors 48 may also be formed or mounted to the upper surface 38 of the base 12. Anchor 48*a* may extend out at an angle $\alpha$ of 45° from a central plane of the device 10 bisecting the device 10. It is also contemplated that the angle $\alpha$ may be between 15° and 75°. Additionally, anchor 48*b* on the other side of the base 12 may extend out at an angle $\alpha$ from the central plane of the device 10. The central axis 50 of anchors 48*a*, 48*b* and any other anchors 48 formed on the upper surface 38 of the base 12 may also be parallel to the upper surface 38 of the base 12. In this disclosure, the central axis 50 of the anchors 48 is described and shown, as being parallel to the upper surface 38. However, in certain instances, the upper surface 38 may have a configuration other than flat. In these instances, the central axis 50 of the anchors 48 may be generally parallel to the support surface 36 upon which, the device 10 is designed to rest, The cradle 18 may be disposed between the first plates 40*a, b* of the first and second upright members 14, 16. The cradle 18 may have a concave configuration so that the cradle 18 may hug the patient's leg 21 when placed thereon. Padding 54 may be secured to the upper surface of the cradle 18 to provide comfort to the patient 22 as the patient 22 performs his or her ankle exercises. Opposed distal end portions 56*a, b* of the cradle 18 may be flat and parallel with each other. The opposed distal end portions 56*a, b* may be parallel to the first plates 40*a, b* of the first and second upright members 14, 16. The opposed distal end portions 56*a, b* may have a threaded post 58 attached thereto and receivable into the slot 46*a, b* formed, in the first plates 48*a, b* of the first and second upright members 14, 16. A nut 60 with a handle may be mounted to the threaded post 58 to position the cradle 18 on the first plates 48*a, b*. As discussed above, the slots 46*a, b* are in alignment Moreover, the threaded post 58 attached to the opposed distal end portions 56*a, b* are also aligned about a common axis. As such, the cradle 18 can be set at any vertical position along the slot 46*a, b*. The posts 58 can slide within the slots 46*a, b*. Also, the cradle 18 can be rotated about the common axis of the posts 58. Once the vertical position and the angular orientation of the cradle 18 are positioned in the optimal position, the adjustable knobs 60 may be tightened onto the threaded posts 58. The lateral sides of the first plates 40*a, b* may additionally have graduation marks 62 so that the patient 22 can vertically position the cradle 18 at the same position when needed each time he or she is up for a particular exercise.

The extension member 24 may be removably attached to one of the anchors 48, as shown in FIGS. 1 and 3-5. In FIG. 1, the extension member 24 is attached to the anchor 48*c*. However, the extension member 24 may be secured to any one of the other anchors 48. The extension member 24 is shown as having a straight elongate rod configuration. The first distal end of the extension member 24 may be inserted into the open end of the anchor 48. To secure the extension member 24 to the anchor 48, the anchor 48 may have a threaded through hole which receives a set screw 52 having an adjustment knob. Once the extension member 24 is inserted into the anchor 48, the patient 22 may tighten the set screw 52 with the adjustment knob to prevent the extension member 24 from pulling out or detaching from the anchor 48 while the patient 22 exercises his or her ankle. The opposed second distal end of the extension member 24 may be formed with a hook or eyelet 26. The hook or eyelet 26 is shown as being an eyelet. However, other configurations are also contemplated.

Figure 5:
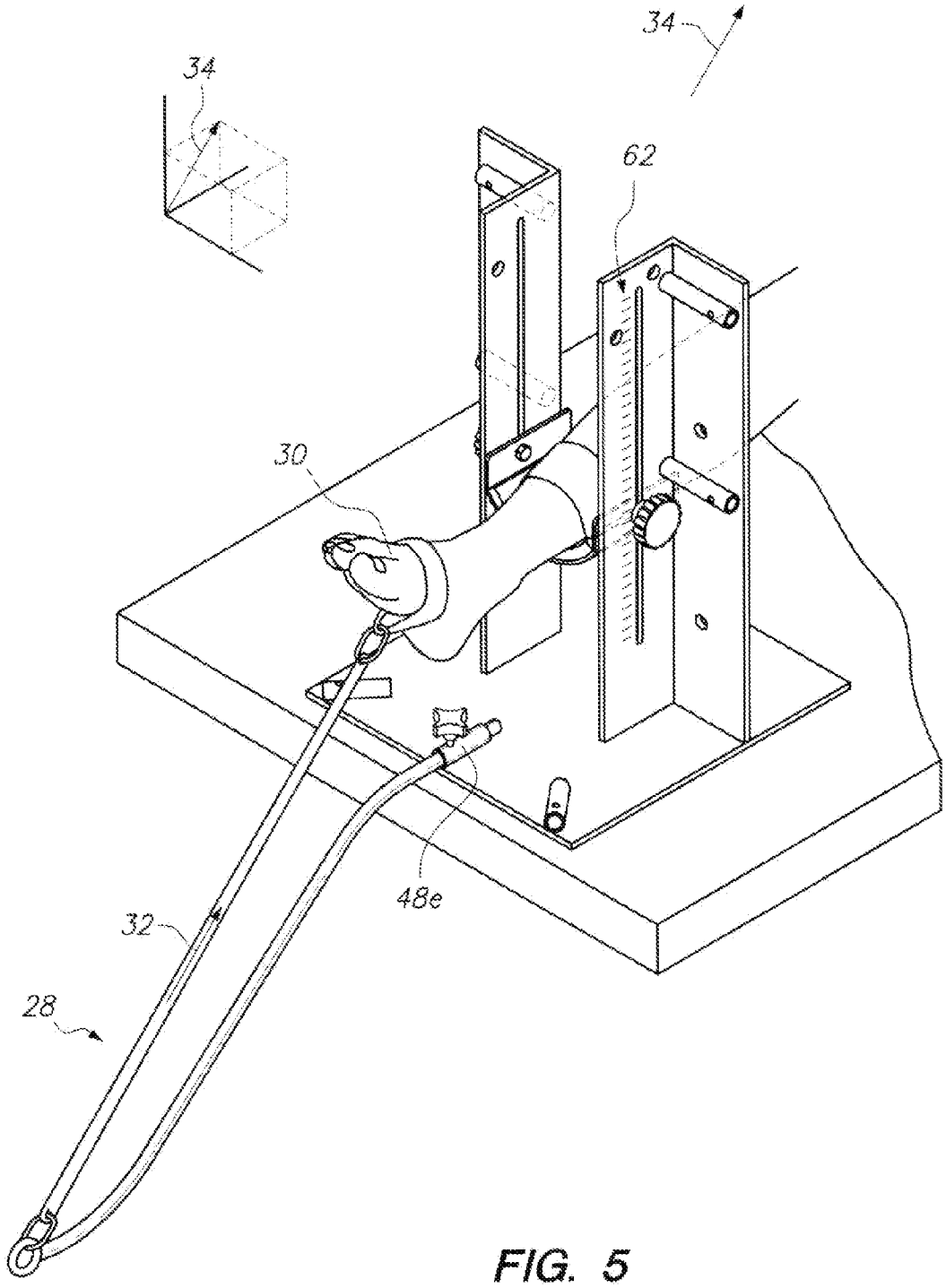
FIG. 5 is a perspective view of the ankle strengthening device shown in FIG. 1 with an extension member having an S-shaped configuration.

Additionally, although the extension member 24 is shown as having a straight, elongate rod configuration, other configurations are also contemplated. By way of example and not limitation, the extension member 24 may be shorter or longer than shown. Additionally, the extension member 24 may have a curved S shape, as shown in FIG. 5.

Figure 2:
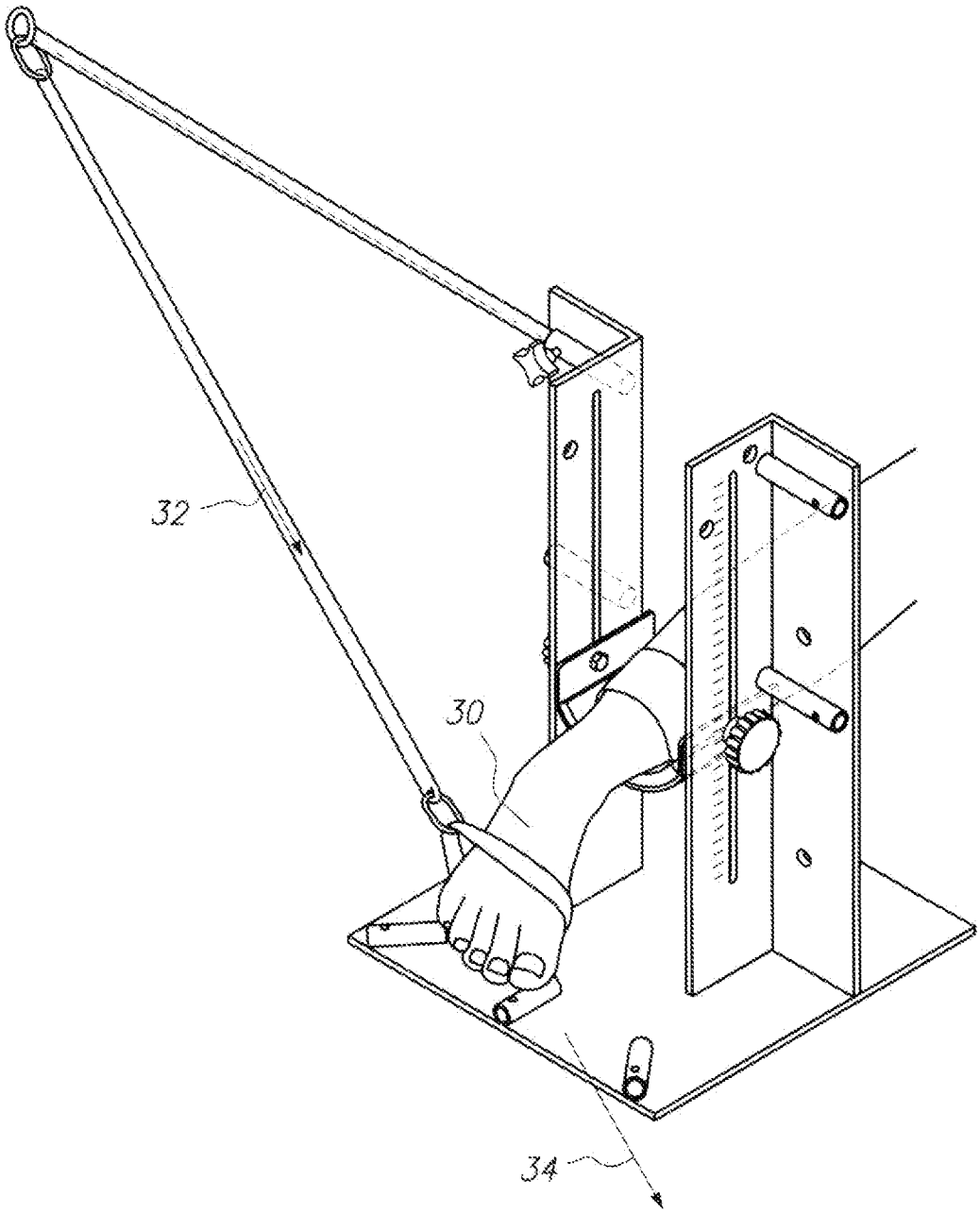
FIG. 2 is a perspective view of the ankle strengthening device shown in FIG. 1 with the foot of the patient moving his or her foot by pivoting his or her ankle in a direction in alignment with a direction indicated by an elastic member.

Referring now to FIGS. 1 and 2, the device 10 is shown as being set up for a patient 22 to exercise his or her tibialis posterior muscle which is immediately behind the tibia of the leg 20. To strengthen the tibialis posterior muscle, the extension member 24 is inserted into the upper anchor 48*c* as shown in FIG. 1. When the exercise is to be performed while sitting on a chair, the cradle 18 is positioned below the seat portion of the chair and below the anchor 48*c*. The front to back angle of the cradle 18 is set so as to be comfortable to the patient 22 as he or she rests his or her leg 20 on the cradle 18.

The band 28 is secured to the hook or eyelet 26 of the extension member 24 and the foot 30 of the patient 22 with a strap 23. The patient 22 sits down on the chair and places his or her leg 20 on the cradle 18. A strap 62 is placed around the lower leg 20 and secured to the cradle 18 so that the patient's leg 20 is immobilized. As shown in FIG. 1, the band 28 is pointed downward as shown by arrow 32. This direction 32 is the same direction that the patient 22 must rotate his or her ankle and move his or her foot 30 to exercise or strengthen the tibialis posterior muscle. The band 28 provides a visual aid to the patient 22 to indicate proper movement of the foot 30. Alter setting up the device 10, the band 28 provides a clear indication of the direction and movement expected of the patient's foot 30.

The purpose of providing the visual aid in conjunction with the device 10 is to allow the patient 22 to strengthen a particular muscle with minimal or no supervision by a physical therapist. The exercise can be performed at home. At a physical therapists office, the patient 22 does not require constant supervision. If the foot 30 is pivoted at another direction out of alignment with the direction 32 of the band 28, such movement may not exercise the proper muscle. In the example shown in FIGS. 1 and 2, if the foot 30 is moved upward, the muscle being exercised would be the tibialis anterior muscle which is located in front of the shin of the leg thereby defeating the entire purpose of the physical exercise to exercise the tibialis posterior muscle. Moreover, it is also contemplated that the device may be sold directly to people. The device may come with instructions on how to set up and use the device to properly target a specific ankle muscle.

The extension member 24 may be secured to any one of the other anchors 48, Also it is contemplated that different size and shape extension members 24 may be secured to any one of the anchors 48 depending on the muscle to be exercised. The position of the cradle 18 could also be adjusted. After setting up the extension member 24 and the position and angle of the cradle 18, the patient 22 may engage the device 10. When the band 28 is attached to the hook or eyelet 26 of the extension, member 24 and the foot 30, the direction of the band 28 defines the motion expected of the foot 30 to exercise a particular muscle.

A physical therapist may initially work with the patient 22 to diagnose the patient's 22 physical issue. After diagnosis, the physical therapist may set up the device 10 for the patient 22 by positioning the vertical position of the cradle 18 and its front to back angular position. The patient 22 may place his or her leg 20 on the cradle 18 and be strapped to immobilize the leg 20. The patient 22 is instructed to move his or her foot 30 in the direction 32 indicated by the band 28. Once the physical therapist determines that the patient 22 is properly conducting the physical exercise to exercise a specific muscle associated with, the ankle, the physical therapist, may record the vertical height of the cradle 18 as indicated by the linear graduation marks on the first plates 40*a, b* of the first and second upright members 14, 16 and the front to back angular position of the cradle 18 as Indicated by the angular graduation marks on the first plates 40*a, b* of the first and second upright members 14, 16. The physical therapist may determine that one or more ankle exercises are necessary. For each of the ankle exercises, the physical therapist may indicate the vertical position and angular position of the cradle 18, the type of extension member 24 and the particular anchor to which the extension member 24 should be attached. The patient 22 may conduct the exercises at home since the device 10 limits the variables that might cause the patient 22 to improperly conduct the ankle exercise and strengthen the wrong muscle. Plus, the hand 28 indicates the motion to be expected of the patient's foot 30.

Figure 6:
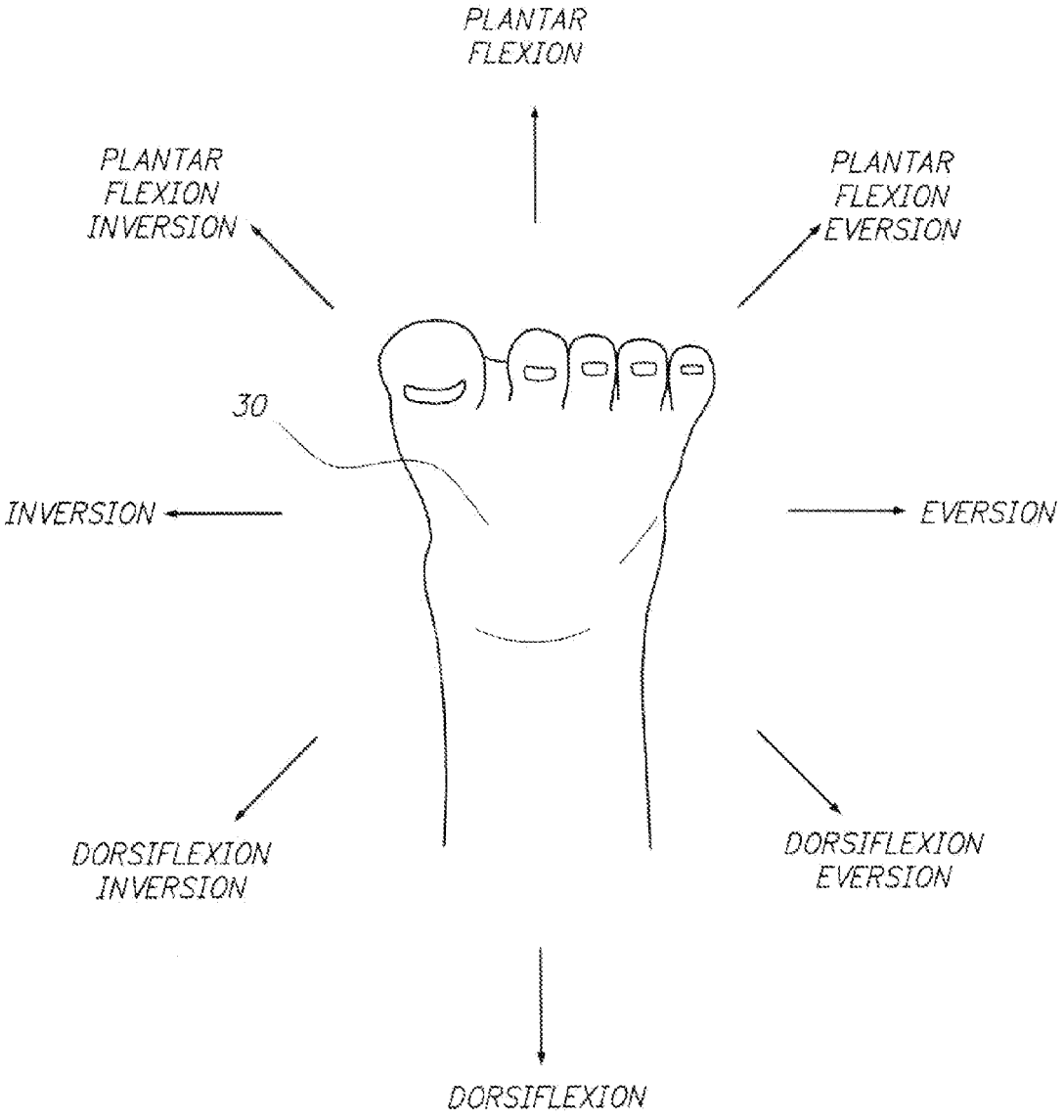
FIG. 6 is a top perspective view of a right foot and ankle illustrating various foot and ankle movements.

Referring now to FIG. 6, a top view of the patient's 22 right foot 30 is shown. To exercise a particular ankle muscle, the patient 22 must pivot his or her ankle so that the foot 30 performs one of the eight (8) movements identified and shown in FIG. 6. Please note that the ankle exercise shown in FIGS. 1 and 2 is ankle inversion with associated plantar flexion. Moreover, please note that there is an additional downward component of the foot movement necessary to exercise the tibialis posterior muscle, for a pure inversion movement, the extension member 24 may be mounted to anchor 48*d* to bring the hook or eyelet 26 to the same elevation as the foot 30. In this instance, the direction 32 of the band 28 would not have a downward component. The patient 22 would merely shift the foot 30 to perform the inversion.

Figure 3:
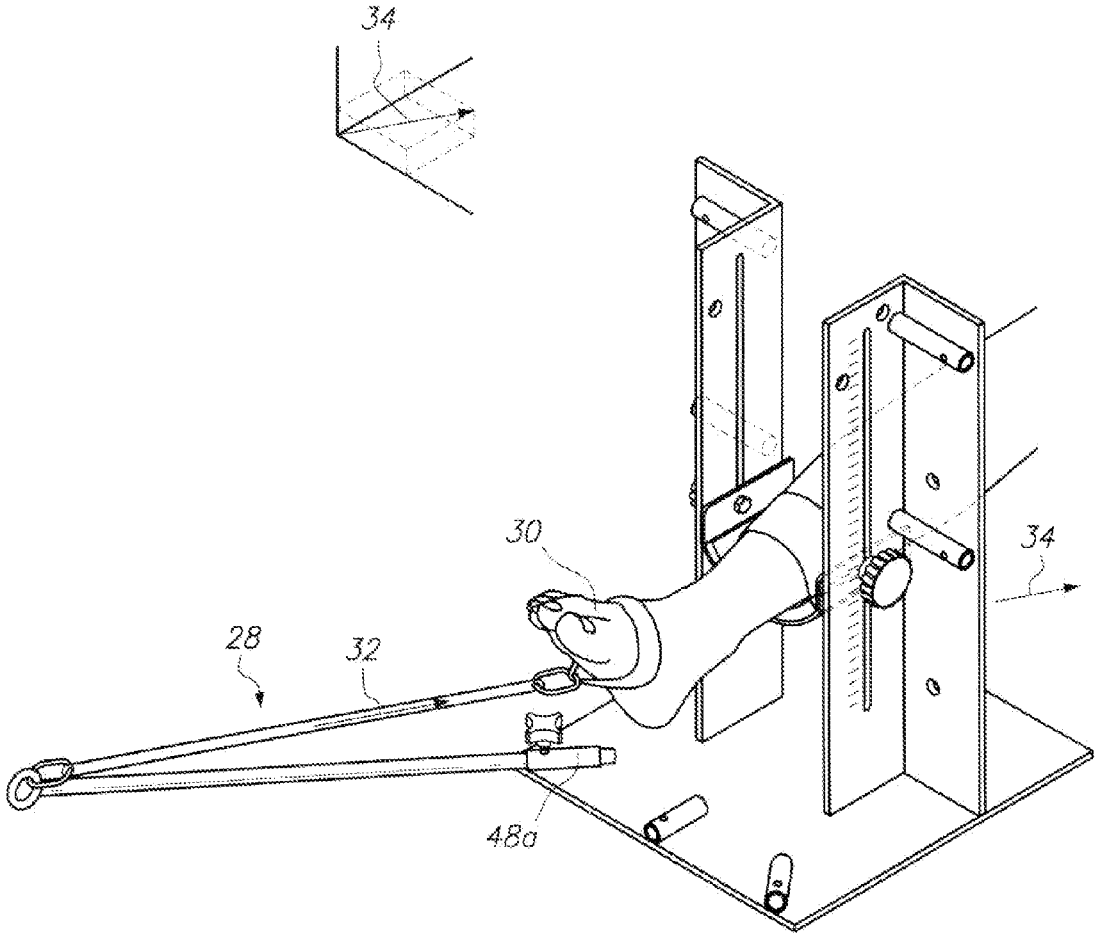
FIG. 3 is a perspective view of the ankle strengthening device shown in FIG. 1 with an extension member secured to a different, anchor of the frame of the device.

Referring now to FIG. 3, the extension member 24 is mounted to the anchor 48*a*. When the elastic member is attached to the hook or eyelet 26 and the foot 30, the direction 32 of the band 28 indicates that the foot 30 should move in the dorsiflexion inversion direction shown in FIG. 6. There is also a slight upward, component in that movement.

Figure 4:
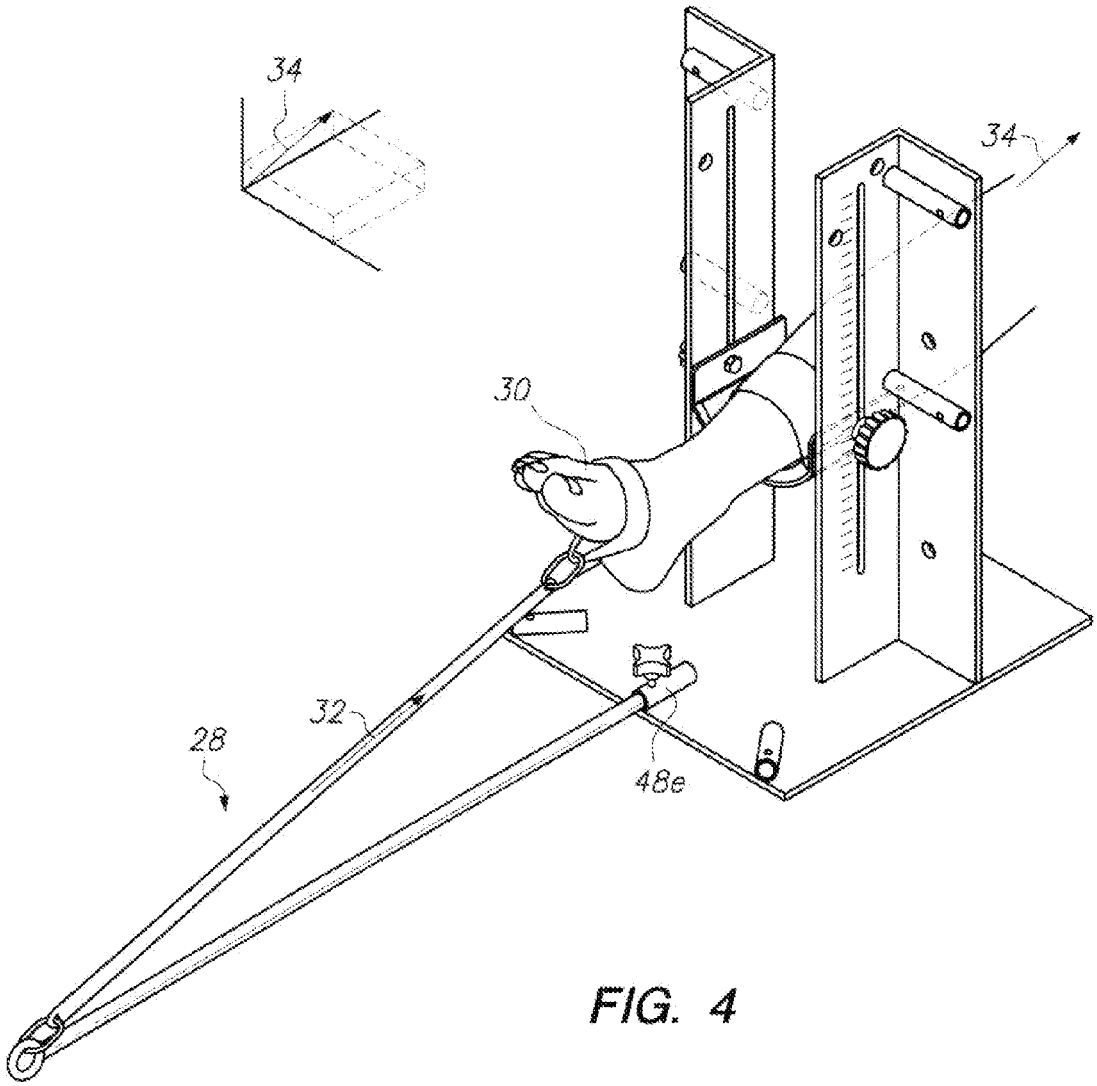
FIG. 4 is a perspective view of the ankle strengthening device shown in FIG. 1 with the extension member secured to a different anchor of the frame of the device.

Referring now to FIG. 4, the extension member 24 is attached to anchor 48*e*. The band 28 is attached to the hook or eyelet 26 and the foot 30 of the patient 22. The direction 32 of the band 28 indicates the dorsiflexion direction.

As discussed above, the extension member 24 may have other configurations. Referring to FIG. 5, the extension member 24 may have, an S-shaped configuration. The S-shaped extension member 24 permits the user to obtain a particular direction 32 of the band 28 to exercise a particular ankle muscle of the patient 22.

The above description is given by way of example, and not limitation. Given the above disclosure, one skilled in the art could devise variations that are within the scope and spirit of the invention disclosed herein, including various ways of forming the anchor. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An ankle strengthening exercise device for strengthening one or more muscles associated with an ankle, the device comprising:

a leg cradle configured to support a calf of the leg so that a foot of the leg is free to move linearly, the leg cradle positioned at an elevation on a frame, the frame comprising:

first and second upright members, each of the upright members having first and second sides, the first sides having a slot for sliding the leg cradle up and down, the second sides having a plurality of fixation points vertically positioned allowing attachment of an elongate extension member for angular positioning of a single elastic member;

the plurality of fixation points disposed about the leg cradle;

the elongate extension member securable to any one of the plurality of fixation points so that a distal end portion of the elongate extension member is positioned laterally, at a skewed angle or in front of the ankle when the leg cradle supports the leg at or above the ankle and below the knee; and the single elastic member defining first and second opposed end portions, the first end portion configured to be removably securable to a person's foot and the second end portion configured to be removably securable to the distal end portion of the elongate extension member;

wherein a length of the elastic member indicates a single direction of linear movement of the foot of the person to be made to exercise and strengthen a particular muscle of the person's ankle so that the single elastic member primarily moves along the single direction during movement of the foot and rotation of the ankle.

2. The device of claim 1 wherein the slots of the first sides being in alignment with each other so that the leg cradle may be positioned at various elevations on the frame and at various angles.

3. The device of claim 1 wherein the elongate extension member has a straight configuration.

4. The device of claim 3 further comprising a plurality of elongate extension members, each elongate extension member being a different length.

5. The device of claim 1 wherein the elongate extension member has an S shaped configuration.

6. The device of claim 1 wherein each of the plurality of fixation points has a hole configuration oriented at a different angle to provide a variety of positional angles of the elongate extension member when the elongate extension member is secured to one of the plurality of holes.

7. The device of claim 1 wherein the fixation points are holes.

8. The device of claim 3 further comprising a plurality of elongate extension members, each elongate extension member having an identical length.

9. The device of claim 1 wherein the elongate extension member is a single elongate extension member.

10. The device of claim 1 wherein the fixation point is an aperture and the elongate extension member is inserted into the aperture.

11. The device of claim 1 wherein the distal end portion of the elongate extension member is configured as a hook or eyelet.

12. The device of claim 1 wherein the single elastic member moves laterally no more than 1 inch during movement of the foot and rotation of the ankle.

13. The device of claim 1 wherein the first end portion of the single elastic member is configured to be removably securable to the person's foot with a strap.

* * * * *